United States Patent [19]

Harris, Jr.

[11] 4,264,024

[45] Apr. 28, 1981

[54] SMOKING PIPE SLING

[76] Inventor: Ellsworth L. Harris, Jr., 4624 G St., SE., Washington, D.C. 20019

[21] Appl. No.: 971,945

[22] Filed: Dec. 21, 1978

[51] Int. Cl.[3] ..... A45C 11/00

[52] U.S. Cl. ..... 224/250; 131/260; 206/244; 224/223; 224/242

[58] Field of Search ..... 224/250, 914, 904, 191, 224/223, 226, 232, 242, 247, 253, 239, 148, 183; 206/244, 86, 227; 131/260

[56] References Cited

U.S. PATENT DOCUMENTS

| | | | |
|---|---|---|---|
| 1,517,588 | 12/1924 | Sasaki | 224/242 |
| 1,605,195 | 11/1926 | Lewis | 224/148 |
| 2,654,514 | 10/1953 | Jensen | 224/250 |
| 3,130,883 | 4/1964 | MacKool | 224/222 X |
| 3,938,717 | 2/1976 | Theodore | 224/183 |
| 4,044,932 | 8/1977 | Harris | 224/242 |

*Primary Examiner*—Robert J. Spar
*Assistant Examiner*—Jerold M. Forsberg
*Attorney, Agent, or Firm*—Harvey B. Jacobson

[57] ABSTRACT

A sling for supporting one or more smoking pipes in a secure manner with the pipes being readily removable from the sling and easily placed into the sling. The sling is provided with a loop structure for receiving a belt to support the sling at the waist region of a wearer or alternatively, the sling may be supported by a neck or shoulder encircling strap or throng or by other suitable means. The sling includes a main body member of leather or equivalent flexible material having some degree of rigidity in order to be shape sustaining with the lower end of the body member being reversely folded to provide a pipe retaining member which together with the body member defines a vertically opening pocket for receiving the bowl portion of one or more smoking pipes. The other end portion of the body member is provided with a pipe stem retaining strap attached thereto for overlying and securing a pipe stem or stems with both the pipe stem retaining strap and the pipe retaining member being easily released from their operative positions to facilitate removal of a pipe from the sling and to facilitate placement of a pipe into the sling.

2 Claims, 9 Drawing Figures

Fig. 5
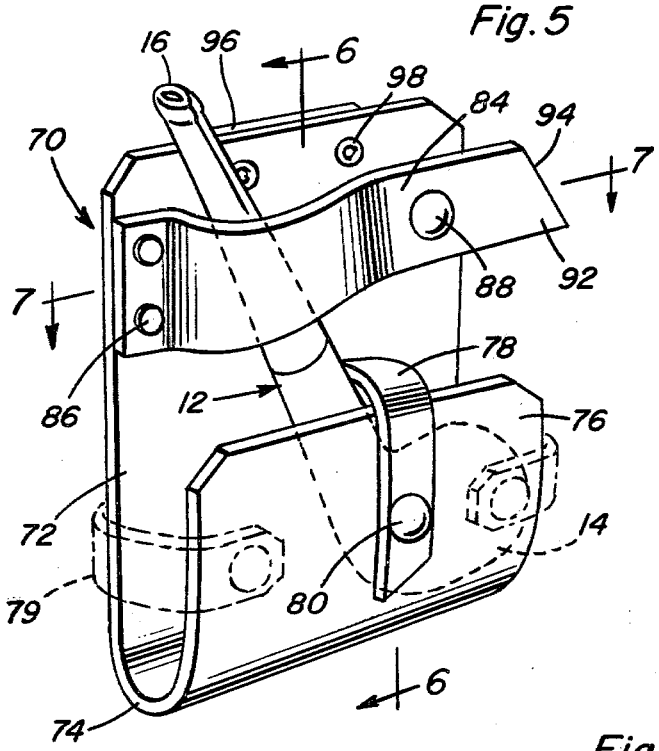
Fig. 6
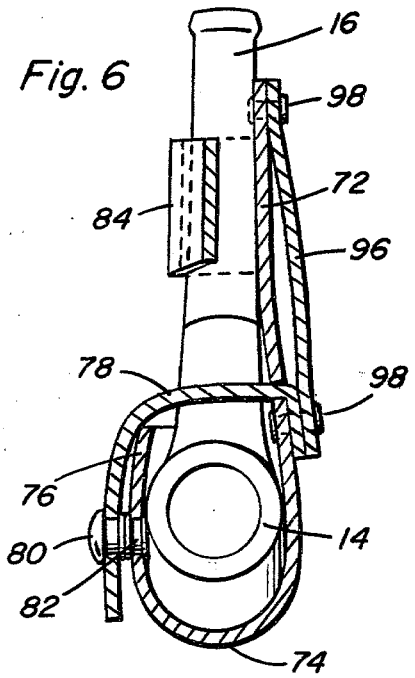
Fig. 7
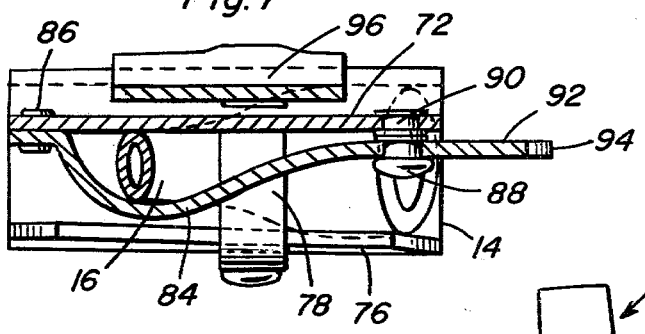
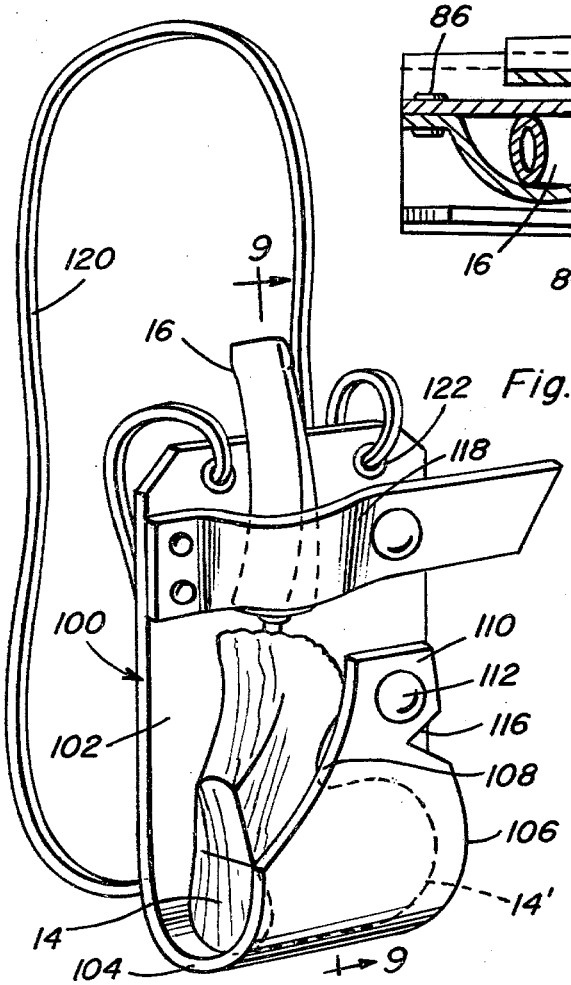
Fig. 8
Fig. 9
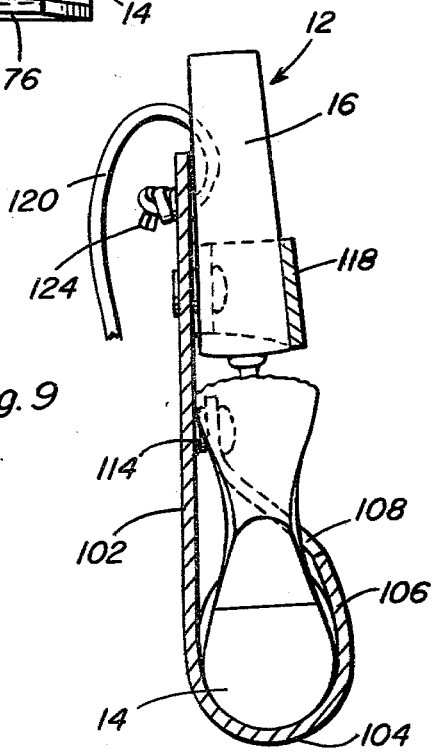

SMOKING PIPE SLING

BACKGROUND OF THE INVENTION

1. Field of the Invention

This invention relates to a pipe sling for supporting a smoking pipe or pipes from the belt of a pipe smoker to enable a pipe or pipes to be effectively supported and carried during normal activities of a pipe smoker with the retaining components of the sling being releasably by snap fasteners or the like to facilitate quick and easy removal of a pipe or pipes and to provide corresponding ease of placement of a pipe or pipes into the sling.

2. Description of the Prior Art

My prior U.S. Pat. No. 4,044,932 issued Aug. 30, 1977, discloses a smoking pipe sling adapted to be attached to the belt of a pipe smoker and including a pipe retaining pocket and pipe stem retaining strap adjustably retained in position by flexible thongs threaded through selected apertures in a series of apertures along the side edges of the components of the sling. The prior art cited during prosecution of the application which matured into my prior patent disclose certain features considered pertinent thereto. The prior art cited by the U.S. Patent Office during prosecution of the application which matured into my above-mentioned patent as well as the structure disclosed in my prior constitute the only prior art known to me.

SUMMARY OF THE INVENTION

An object of the present invention is to provide a smoking pipe sling which includes a body member of flexible, shape and sustaining material, such as leather, having a lower end reversely folded to form a pocket for receiving a pipe bowl or bowls with a flexible strap or straps having at least one detachable end portion associated with the pocket to maintain the configuration of the pocket and maintain the bowl or bowls in the pocket with the detachable end portion enabling easy assembly and disassembly of the pipe bowl or bowls with the pocket.

Another object of the invention is to provide a sling in accordance with the preceding object in which the body member is also provided with a stem retaining strap connected to the body member adjacent one edge portion thereof and provided with a releasable fastener or fasteners for securing a pipe stem or pipe stems alongside the surface of the body member above the pocket.

Still another object of the invention is to provide a smoking pipe sling which is quite simple in construction but yet dependable and long lasting and capable of supporting a pipe or pipes of various shapes and sizes with a belt loop or other alternative supporting means being provided for supporting the sling in a desired location.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 5 is a perspective view of another embodiment of the invention for supporting a single pipe.

FIG. 6 is a vertical sectional view taken substantially upon a plane passing along section line 6—6 of FIG. 5 illustrating the structural details of this embodiment of the invention.

FIG. 7 is a transverse, sectional view taken substantially upon a plane passing along section line 7—7 of FIG. 5 illustrating the structure of the pipe stem retaining strap and its relationship to the pipe stem and body member.

FIG. 8 is a perspective view of a further embodiment of the invention illustrating an alternative supporting structure therefor.

FIG. 9 is a vertical sectional view taken substantially upon a plane passing along section line 9—9 of FIG. 8 illustrating the structural details of this embodiment of the invention.

DESCRIPTION OF THE PREFERRED EMBODIMENTS

Figure 1:
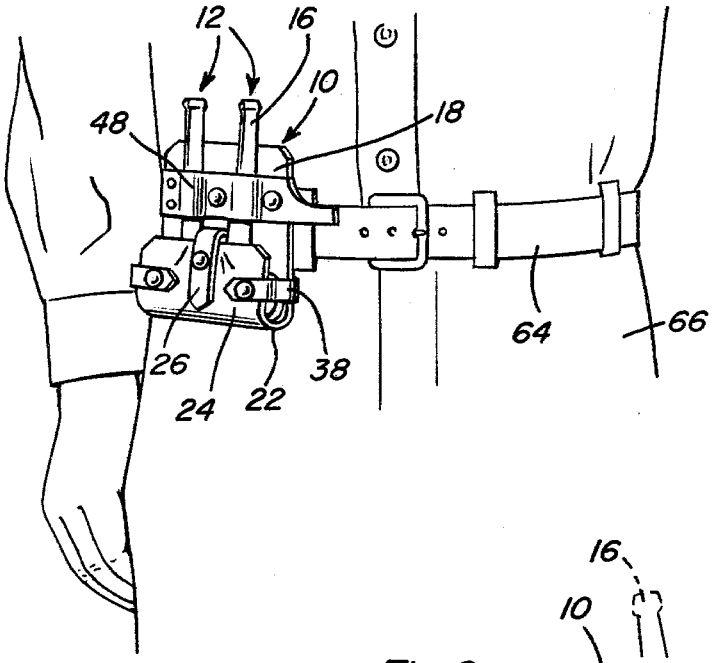
FIG. 1 is a perspective view of the smoking pipe sling of the present invention mounted on the belt of a pipe smoker or the like with two pipes supported therein.

Referring now specifically to FIGS. 1-4 of the drawings, the embodiment of the smoking pipe sling disclosed therein is generally designated by the numeral 10 and is constructed in a manner to enable it to effectively support two smoking pipes 12 each of which is conventional in construction and includes a pipe bowl 14 and a pipe stem 16. The pipes may be identical in configuration or may vary in construction with the pipe bowls being optimally supported with the open ends thereof facing outwardly in relation to each other. While two pipes 12 have been illustrated, the sling 10 may also be used for effectively supporting a single pipe.

Figure 3:
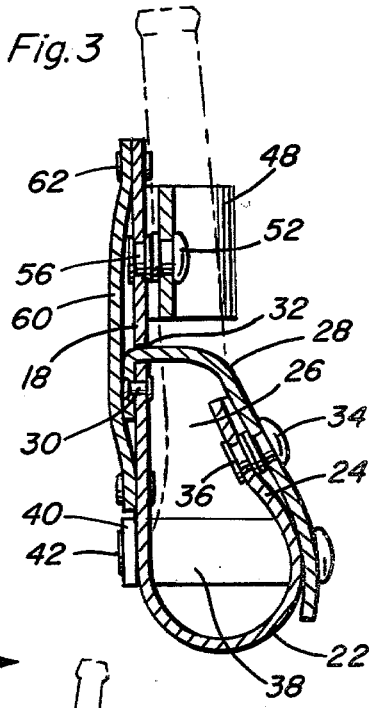
FIG. 3 is a vertical sectional view taken substantially upon a plane passing along section line 3—3 of FIG. 2 illustrating the specific structural details of the invention.

The pipe sling 10 includes a body member 18 which, in its original configuration, is rectangular in configuration with the corners 20 being mitered to eliminate sharp corners. The body member 18 is constructed of leather such as used in constructing a man's belt, or other similar material such as fabrics, plastics, and the like, having a flexible character but yet some degree of rigidity to sustain its shape. The body member 18 is provided wth a reverse fold 22 at its lower end and extends upwardly as a pipe retaining member 24 with the free edge of the pipe retaining member generally being disposed at the vertical center of the body member 18 when in the operative position as illustrated in FIGS. 2 and 3 with the pipe retaining member cooperating with the body member to define a vertically opening pocket 26 which receives the pipe bowls 14 and adjacent portions of the stems 16 as illustrated in FIGS. 2 and 3.

To retain the pipe retaining member 24 in its pocket forming operative position, a centrally disposed strap 28 has one end connected to the central portion of the body member 18 by a rivet 30 extending therethrough. As illustrated in FIG. 3, the end of the strap 28 extends through a slot 32 in the body member and extends along the rear surface thereof with the rivet extending through the body member and the portion of the strap along the rear surface thereof to more securely anchor the strap 28 to the body member 18. The strap 28 extends over top of the free edge of a pipe retaining member 24 and includes a female snap fastener element 34 thereon in spaced relation to the free end thereof for detachable fastening engagement with a male snap fastener element 36 mounted on the center edge portion of the pipe retaining member 24. The strap 28 thus extends between the pipe stems 16 or alongside of one pipe stem if only one is mounted in the sling and retains the upper edge portion of the pipe retaining member 24 in operative position to retain the shape of the pocket 26.

For preventing the pipe bowls 14 from exiting from the side edges of the pocket 26, a pair of pipe bowl retaining straps 38 are provided with the two straps 38 being identical and oriented at opposite sides of the sling. Each strap 38 includes an inner end 40 extending along the rear or inner surface of the body member 18 and secured thereto by a rivet or equivalent fastening device 42 and extending forwardly past the side edge of the body member 18 and the side edge of the pipe retaining member 24 and extending inwardly over the outer surface of the pipe retaining member 24. The free end of the strap 38 is provided with a female snap fastener element 44 for engagement with a male snap fastener element 46 anchored to the pipe retaining member 24. Thus, the straps 38 combined with the strap 28 and the pipe retaining member 24, the reverse fold 22 and the lower portion of the body member 18 all cooperate to retain the pipes 12 securely retained with the strap 28 keeping the two pipes separated from each other and the straps 38 preventing the pipe bowls from moving laterally outwardly. With this construction, the device will effectively support and retain a single pipe as well as two pipes.

Figure 2:
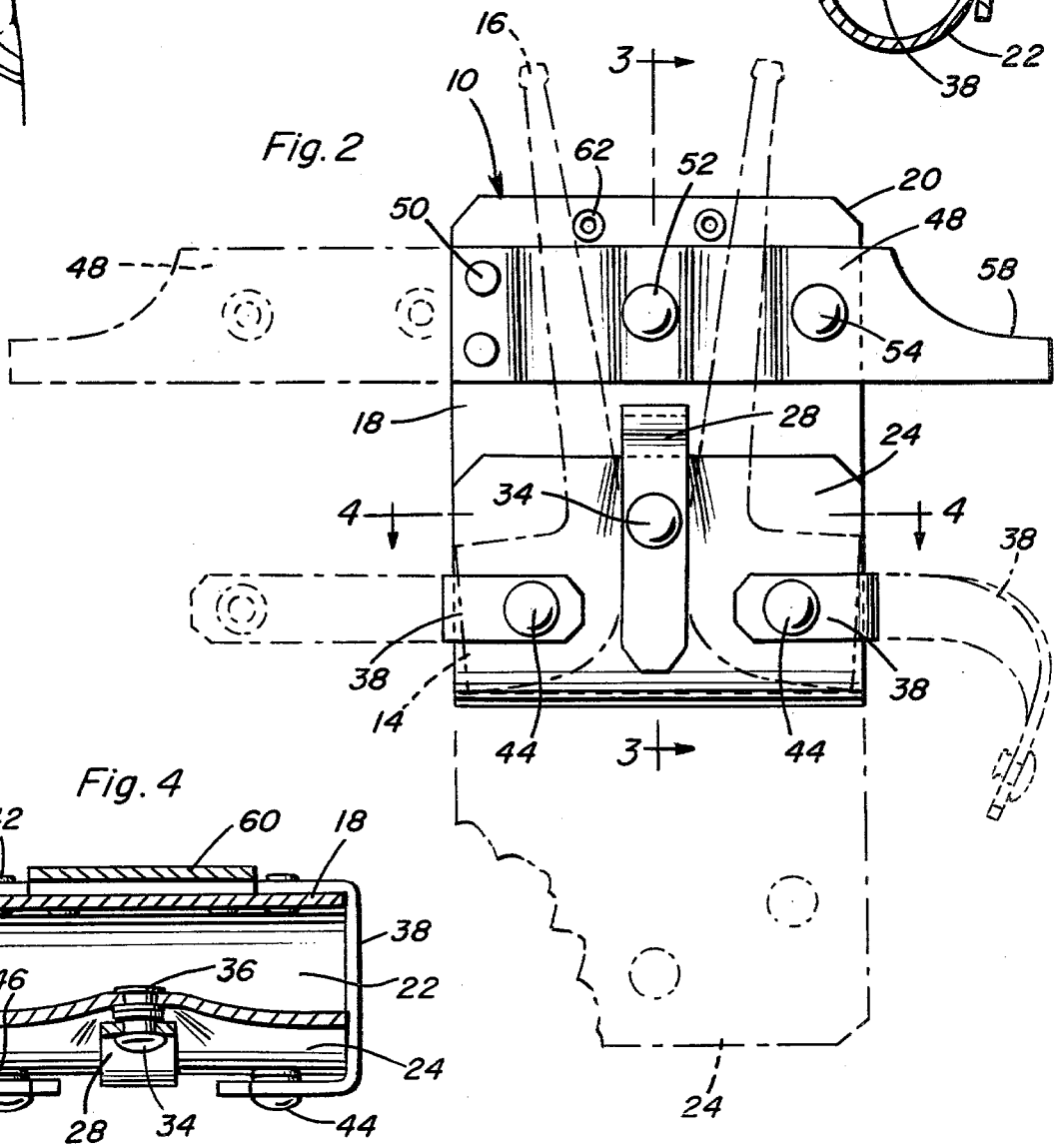
FIG. 2 is a front elevational view of the pipe sling illustrating the arrangement of the structural components in their operative full line position and in their inoperative broken line position.
Figure 4:
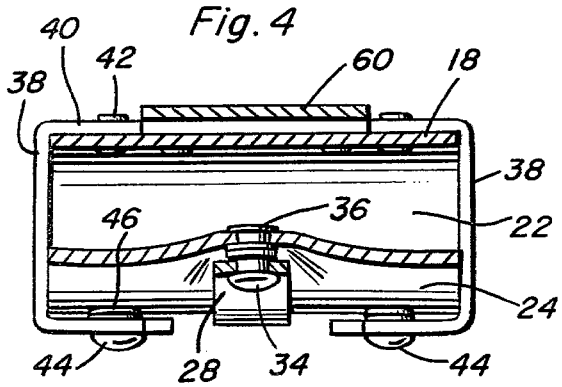
FIG. 4 is a transverse, sectional view taken substantially upon a plane passing along section line 4—4 of FIG. 2 illustrating further structural details of the invention.

At the upper end portion of the body member 18, a pipe stem retaining strap 48 is provided with one end of the strap being anchored to a side edge portion of the body member 18 by rivets 50 or equivalent fastening means and the strap 48 extends in overlying relation to the pair of pipe stems 16 as illustrated in FIG. 2. The pipe stem retaining strap 48 includes a pair of longitudinally spaced female snap fastener elements 52 and 54 mounted thereon for detachable fastening engagement with male snap fastener elements 56 which are correspondingly spaced for detachable engagement with the female snap fastener elements. The snap fastener assemblies are located so that one of them is disposed between the pipe stems 16 generally along the vertical center of the body member 18 as illustrated in FIG. 3 and the other snap fastener assembly is adjacent the side edge of the body member 18 remote from the rivets 50 thereby securely retaining the pipe stems 16 and preventing upward movement of the pipes 12 in relation to the sling. The free end of the pipe stem retaining strap 48 is provided with a reduced height tab 58 which projects beyond the side edge of the body member 18 and provides a convenient griping handle for separating the snap fastener assemblies to facilitate insertion of an removal of the pipes in relation to the sling.

For supporting the body member 18, the inner surface thereof is provided with a strap 60 having the upper and lower edges thereof anchored to the body member 18 as by rivets 62 or other suitable fastening means with the central portion of the strap 60 being free of the body member 18 thus defining a loop for receiving a belt 64 such as normally worn at the waist region of a pipe smoker or user 66, thus securely mounting the sling 10 in a convenient location on the belt 64 with it being pointed out that the sling 10 may be positioned to either side of the waist region of the pipe smoker so that either hand may be used to remove a pipe from or place a pipe in the sling. This renders the device quite convenient for use by individuals normally using their hands to perform some function such as driving an automobile or other vehicle and the like.

Referring now to FIGS. 5–7, a simplified embodiment of the pipe sling is generally designated by numeral 70 which is primarily adapted to support a single pipe 12 and includes a main body 72, a reverse fold 74 at the lower edge thereof and a pipe retaining member 76 corresponding to the same components as illustrated in FIGS. 1–4. In this embodiment of the invention, a centrally disposed strap 78 is attached to the center of the body member 72 and extends forwardly and overlies the free edge of the pipe retaining member 76 and is provided with a female snap fastner element 80 adjacent the free end thereof for detachable engagement with a male snap fastner element 82 mounted centerally on the pipe retaining strap 76 and as shown in broken lines, optional side straps 79 are provided. This structure is quite similar to the straps 28 and 38 in FIGS. 1–4 and functions in substantially the same manner and is secured to the body member in the same manner.

In this embodiment of the invention, a pipe stem retaining strap 84 is attached to one edge of the body member 72 by rivets 86 or the like and includes a single female snap fastener element 88 adjacent the free end thereof for engagement with a male snap fastener element 90 attached to the body member 72 adjacent the side edge thereof remote from the rivets 86 as illustrated in FIG. 7 for overlying and engaging the pipe stem 16 thereby securing the pipe bowl 18 in the pocket formed by the pipe retaining member 76, the reverse fold 74, the body member 72 and the strap 78. With the pipe 12 disposed in the sling 70 in the slanted manner illustrated, the engagement of the stem 16 by the strap 84 will prevent movement of the pipe 12 to a vertical position thereby retaining the bowl in the position illustrated in FIG. 5 and preventing the bowl from exiting from the left side of the pocket unless the snap fastener element 88 is separate and the strap 84 loosened or substantial upward force is exerted on the pipe stem 16. Under normal use conditions, the structure will effectively retain a pipe mounted in the sling 70. To facilitate manipulation of the pipe stem retaining strap 84, it is provided with a projecting end portion 92 provided with a beveled or mitered end edge 94 which extends beyond the side edge of the body member 72 thereby facilitating manipulation thereof even without looking at the end of the strap. The body member 72 is provided with a belt loop forming strap 96 on the rear surface thereof secured by rivets 98 which structure operates in the same manner as the supporting structure illustrated in the embodiment of FIGS. 1–4.

Referring now specifically to FIGS. 8 and 9 of the drawings, a further embodiment of the invention is generally designated by the numeral 100 and includes a body member 102 having a reverse fold 104 at the lower edge thereof to form a pipe retaining member 106 which extends upwardly and defines a pocket for receiving the bowl 14 of a pipe 12 which is differently shaped from the other pipes illustrated with this pipe including a curved stem 16. In this embodiment, the pipe retaining member 106 has one corner edge thereof cut in an arcuate curve 108 thus defining a narrow tab at 110 one corner of the member 106 as illustrated in FIG. 8. This tab is provided with a female snap fastener element 112 for association with a male snap fastener element 114 mounted on the body member 102 and effectively snugly embraces the bowl 14 which tapers to a larger diameter at the open end 14' so that the pipe bowl cannot move laterally outwardly of the pocket toward the left as illustrated in FIG. 8 with the snap fasteners 112 and 114 preventing movement of the pipe bowl to the right. A notch 116 is provided in the side edge of the member 106 adjacent the female snap fastener element 112 to further define the tab 110 and enable location and manipulation thereof by using the sense of touch thereby facilitating use of the device. In this embodiment of the invention, a pipe stem retaining strap 118 identical to the strap 84 in the embodiment illustrated in FIGS. 5–7 is utilized to snugly engage the pipe stem 16.

This embodiment of the invention as well as the other embodiments may be attached with a belt loop forming strap on the inner surface of the body member 102 or it as well as the other embodiments of the invention may be supported by a flexible strap or thong 120 which extends around the neck, shoulder or other region of the body and has terminal ends extending through grommets 122 in the top end of the body member 102 and provided with a knot 124 on each end thereof for anchoring the strap thereto thereby providing an alternative supporting structure. All of the embodiments of the invention may be constructed of readily avialable leather or other equivalent readily available materials.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

What is claimed as new is as follows:

1. A sling for holding a smoking pipe comprising a vertically disposed body member having a lower end thereof reversely folded into overlying spaced relation to the body member to define a pipe bowl retaining member and to form an upwardly opening pocket receiving a pipe bowl with a pipe stem extending upwardly along a front surface of the body member, strap means interconnecting the body member and bowl retaining member to retain the pipe bowl in the pocket, strap means mounted on the body member above the pocket for overlying engagement with a pipe stem for retaining the pipe in the sling, and means supporting said body member from a supporting structure, said strap means interconnecting the body member and pipe bowl retaining member including a single centrally disposed strap connected to a central portion of the body member and having a free end portion extending over a top edge of the pipe bowl retaining member and detachably connected thereto and a pair of end strap members attached to side edge portions of the body member and extending over side edges of the pipe bowl retaining member and releasably connected thereto to enable the pocket to receive the bowls of a pair of pipes with the pipe stems extending upwardly on opposite sides of the central strap, said pipe stem retaining strap means including a horizontally extending strap having one end anchored to a side edge portion of the body member adjacent an upper end thereof and extending across the pipe stems, detachable fastening devices interconnecting the pipe stem retaining strap and the body member at two laterally spaced points to define two pipe stem receiving areas, a free end portion of the pipe stem retaining strap extending beyond a side edge of the body member in the form of a reduced tab to facilitate gripping engagement thereof.

2. The structure as defined in claim 1 wherein said means supporting the body member includes a strap anchored to the rear surface thereof at vertically spaced points to provide a belt loop to enable the sling to be supported from the belt of a pipe smoker.

* * * * *